United States Patent [19]

Stover

[11] 4,083,603

[45] Apr. 11, 1978

[54] METHOD FOR THE SOLUTION MINING OF A MINERAL

[75] Inventor: Dennis E. Stover, Plano, Tex.

[73] Assignees: Atlantic Richfield Company, Los Angeles, Calif.; NM Uranium, Inc., Houston, Tex.; United States Steel Corporation, Pittsburgh, Pa.

[21] Appl. No.: 728,327

[22] Filed: Sep. 30, 1976

[51] Int. Cl.[2] ..... E21B 43/28

[52] U.S. Cl. ..... 299/4

[58] Field of Search ..... 299/4

[56] References Cited

U.S. PATENT DOCUMENTS 2,818,240 12/1957 Livingston ..... 299/4

3,713,698 1/1973 Rhoades ..... 299/4

*Primary Examiner*—Ernest R. Purser

*Attorney, Agent, or Firm*—Ronnie D. Wilson

[57] ABSTRACT

The present invention relates to an improved method for the solution mining of a mineral from a subterranean formation. More specifically, the invention relates to an improved method which enhances significantly the recovery of a mineral from a subterranean formation via solution mining. The improvement comprises injecting oxidant into said formation via a production well simultaneously with the injection of solvent and oxident into said formation via an injection well for a finite period of time and subsequently returning the system to its initial operating mode.

7 Claims, No Drawings

METHOD FOR THE SOLUTION MINING OF A MINERAL

Generally, known methods for solution mining of a mineral in situ utilize an acid or alkaline leach solution for the dissolution of the mineral. An oxidant is injected into the formation along with the leach solution. The mineral is leached from the formation and recovered from a production well via a pregnant leach solution. Various procedures for recovering the mineral from the pregnant leach solution are well known, such as ion exchange.

The process of the present invention is particularly suitable for the leaching of uranium; however, my invention is not so limited. The following description of the present invention will be applied to uranium leaching; however, it is apparent that it is applicable to leaching other mineral values such as copper, nickel, molybdenum, rhenium and selenium where similar problems are encountered.

Although acid leaching solutions can be used in some formations, only alkaline leaching solutions can be used where the particular formation contains significant quantities of acid-consuming gangue.

It is well-known that to increase the recovery of uranium from an underground ore body, it is necessary to convert the relatively insoluble tetravalent state of uranium in the ore to the solubilizable hexavalent state. When using an alkaline leach solution, the dissolution of the uranium in solution occurs in two steps. The first step involves the oxidation of uranium and the second the dissolution of the oxidized uranium in the solution.

It has been found that during the early stages (when the ore body is in a reduced state) of a leach operation utilizing alkaline solutions of ammonium carbonate, sodium carbonate and potassium carbonate and their respective bicarbonates in conjunction with the typical oxidants of air, oxygen, and hydrogen peroxide, the uranium that is oxidized and dissolved near the injection well is reduced and precipitated in the more reduced regions of the formation between the injection well and the production well. Through this action the oxidized region of the formation is depleted of uranium and the reduced region of the formation becomes enriched as the leach operation continues. Therefore, this process of oxidation and dissolution followed by reduction and precipitation continues as the formation becomes progressively oxidized, whereby the region in the immediate vicinity of the production well becomes progressively enriched. The uranium is depleted from a zone in the formation far more quickly than the oxidant consuming gangue species present therein. Therefore, as the uranium oxidation front recedes from the injection well, the available oxidant for oxidation of the uranium decreases. This causes a slower dissolution of uranium and a lower maximum concentration of uranium in solution as the depleted zone moves through the formation. Therefore, there is needed a method whereby a formation containing a mineral such as uranium can be leached with a leach solution without being accompanied by excessive losses of oxidant and a diminishing rate of mineral recovery.

Therefore, it is an object of the present invention to provide an improved method for the solution mining of a mineral from a subterranean formation, applicable generally to minerals requiring oxidation to be leached and to both acid and alkaline leach solutions.

A further object of the present invention is to provide an improved method for the solution mining of uranium.

It is an additional objective of the present invention to provide an improved method for the solution mining of uranium from subterranean deposits which substantially maintains its initial rate of recovery in the later stages of the operation without the needless waste of oxidant.

Other objects, aspects, and the several advantages of the present invention will become apparent upon a further reading of this disclosure and the appended claims.

It has now been found that the objects of the present invention can be attained in a method for the solution mining of a mineral from a subterranean formation containing same in which an injection and production well are drilled and completed within said formation, a leach solution and an oxidant are injected through the injection well into the formation to dissolve the mineral and recover it via a production well, by injecting oxidant at the production well for a finite period of time and subsequent thereto the production well is utilized to recover the dissolved mineral.

In the operation of the improved method to recover uranium, the injecting of the oxidant at the production well requires the physical changing of the equipment at the production well necessary to change a well from a producer to an injector and vice versa. By injecting oxidant at the production well while continuing injection of oxidant bearing fluid at the injection well, uranium which has been precipitated near the production well is oxidized and furthermore will not reprecipitate as it did under initial conditions because of the short flow path to the production well and continuous injection of oxidant at the injection well. Therefore, the uranium will be produced at a higher concentration than previously attainable if no oxidant injection at the production well occurred.

It is preferable that the injecting of the oxidant at the producer take place after a pattern is in the latter stages of its operating life, in order to most efficiently utilize the present invention. Without injecting oxidant at the producer, most of the precipitated uranium at the producer will never be reached by significant amounts of oxidant since most of the oxidant which is injected at the injection well will react with gangue. The gangue reacts with the oxidant significantly reducing its concentration before the injected solution reaches the uranium that has been precipitated downstream near the production well. Thus, only a small amount of oxidant remains available for uranium dissolution.

Recent studies have shown that the uranium oxidation and dissolution process is accompanied by a reprecipitation process such that the solid uranium is dissolved near the injection well and partially redeposited along the flow path toward the projection well. The distribution of the solid uranium between the wells is drastically altered during the course of the in situ leaching such that it concentrates near the producing well late in its operating life.

As this dissolution and redeposition process proceeds, the primary uranium leaching or dissolution zone gradually travels away from the injection well toward the producing well and the flow path for the oxidant to contact the uranium increases. If the oxidant was specific for uranium, the impact of this increasing flow path would be limited to dispersion effects. However, it is clear that conventional oxidants such as oxygen and hydrogen peroxide are not specific for uranium but oxidize other species present in the host formation. These gangue reactions consume the bulk of the injected oxidant (70–80%) and continue to occur in the regions from which uranium has been leached (the barren zone). Thus, the oxidant available in the uranium leaching zone is significantly less than the injected concentration.

In the present invention, subsequent to oxidant injection at the producing well, the pattern is restored to its original operating mode and the production of the uranium rich fluid at the production well is driven by the continuing injection of oxidant bearing fluid at the injection well. The use of the oxidant bearing fluid from the injection well buffers the capacity of the formation to reduce uranium and the net uranium production continues as this oxidant is consumed. The present invention provides the minimum possible flow path length and, hence, contact time between the uranium bearing solution and the reducing species of the formation.

In order to obtain further benefits from the present invention, oxidant injected at the production well needs to traverse one-half (½) the distance between the production well and the injection well. Therefore, the time period required for such traversal is necessarily a function of the distance between the production well and the injection well and the size of the formation. The combination of injecting oxidant at both the injection and production wells greatly inhibits the capacity of the formation to reduce and reprecipitate the dissolved uranium during the operation.

Therefore, by the utilization of the present invention, the recovery of uranium via in situ leaching processes, can be enhanced significantly by most effectively using the available oxygen to oxidize uranium rather than gangue.

I claim:

1. An improved method for the solution mining of a mineral from a subterranean formation containing same in which an injection and production well are drilled and completed within said formation, leach solution and an oxidant are injected through said injection well into said formation to dissolve said mineral, and said dissolved mineral is recovered via said production well, wherein the improvement comprises injecting oxidant via said production well while injecting said leach solution and oxidant through said injection well and subsequently recovering said dissolved mineral from said production well.

2. The improvement of claim 1 wherein said mineral is selected from the group consisting of copper, nickel, molybdenum, rhenium, selenium and uranium.

3. The improvement of claim 1 wherein said leach solution is acidic in nature.

4. The improvement of claim 3 wherein said acid leach solution is selected from the group consisting of hydrochloric and sulfuric acid.

5. The improvement of claim 1 wherein said leach solution is alkaline in nature.

6. The improvement of claim 5 wherein said alkaline leach solution is in aqueous solution of one or more salts selected from the group consisting of ammonium carbonate, sodium carbonate, potassium carbonate and their respective bicarbonates.

7. The improvement of claim 1 wherein said oxidant is selected from the group consisting of air, oxygen and hydrogen peroxide.

* * * * *